US006257673B1

(12) United States Patent
Markham et al.

(10) Patent No.: US 6,257,673 B1
(45) Date of Patent: Jul. 10, 2001

(54) PERCUSSION TOOL FOR BOOM MOUNTED HAMMERS

(75) Inventors: David J. Markham, Tumwater; William D. Blackburn, Federal Way, both of WA (US)

(73) Assignee: Ramco Construction Tools, Inc., Kent, WA (US)

( * ) Notice: Subject to any disclaimer, the term of this patent is extended or adjusted under 35 U.S.C. 154(b) by 0 days.

(21) Appl. No.: 09/428,678

(22) Filed: Oct. 27, 1999

Related U.S. Application Data

(63) Continuation-in-part of application No. 09/048,547, filed on Mar. 26, 1998, now abandoned.

(51) Int. Cl.[7] ..... E21B 10/36

(52) U.S. Cl. ..... 299/100; 299/37.3; 175/414

(58) Field of Search ..... 299/37.3, 37.4, 299/37.5, 100, 69; 175/414; 173/90, 128, 131, 132, 126; 404/133.05, 133.1, 133.2

(56) References Cited

U.S. PATENT DOCUMENTS

| | | | |
|---|---|---|---|
| 2,533,555 | 12/1950 | Canales | 175/320 |
| 2,629,588 | 2/1953 | Neamand | 299/100 |
| 3,027,953 | 4/1962 | Coski | 175/425 |
| 3,258,295 | 6/1966 | Ives et al. | 299/100 |
| 3,336,081 | 8/1967 | Ericsson | 299/113 |
| 3,900,058 | 8/1975 | McArdle | 81/463 |
| 4,144,868 | 3/1979 | Heitbrink | 125/41 |
| 5,188,187 | 2/1993 | Mumper | 173/128 |
| 5,647,447 | 7/1997 | Jones | 175/414 X |
| 5,884,978 | 3/1999 | Bell et al. | 299/100 |

FOREIGN PATENT DOCUMENTS

| | | | |
|---|---|---|---|
| 357 980 | 3/1929 | (BE) . | |
| 926 614 | 5/1973 | (CA) . | |
| 271684 | 3/1914 | (DE) | 404/133.1 |
| 1813174 | 4/1993 | (RU) | 175/135 |

OTHER PUBLICATIONS

Annals des mines de Belgique No. 6, p. 596 XP002106257, undated.

*Primary Examiner*—David Bagnell
*Assistant Examiner*—Sunil Singh
(74) *Attorney, Agent, or Firm*—Kathleen T. Petrich

(57) ABSTRACT

A percussion or hammer tool bit (20) having a substantially rearward shank portion (24) of a first diameter ($d_s$) and an elongated substantially uniformly cylindrical forward tool portion (26) having a second diameter ($d_t$) in the range of 15–20% greater than the diameter of the rearward shank portion. The overall tool length ($L_o$) is 90–95% of the overall tool length of the prior art ($L_{opa}$). The combination of the increased diameter of the forward tool portion and the decreased length of the overall tool length (relative to the prior art) provides substantially the same or greater mass than the prior art tool bit when the tool bit is used percussively, but is less likely to flex, which reduces the likelihood of stress fracture failure. The forward portion (26) includes a striking face (30), such as a blunt (31), moil point (31'), or chisel (31").

13 Claims, 3 Drawing Sheets

-1/3-
FIG. 1
PRIOR ART
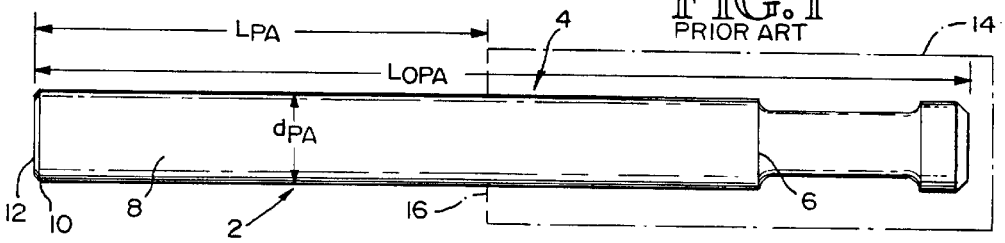
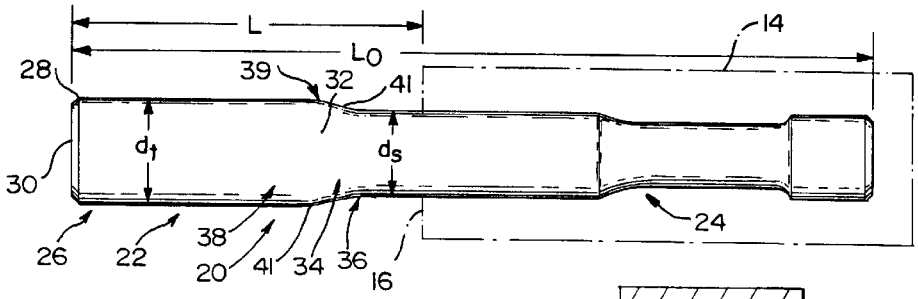
FIG. 2
FIG. 4
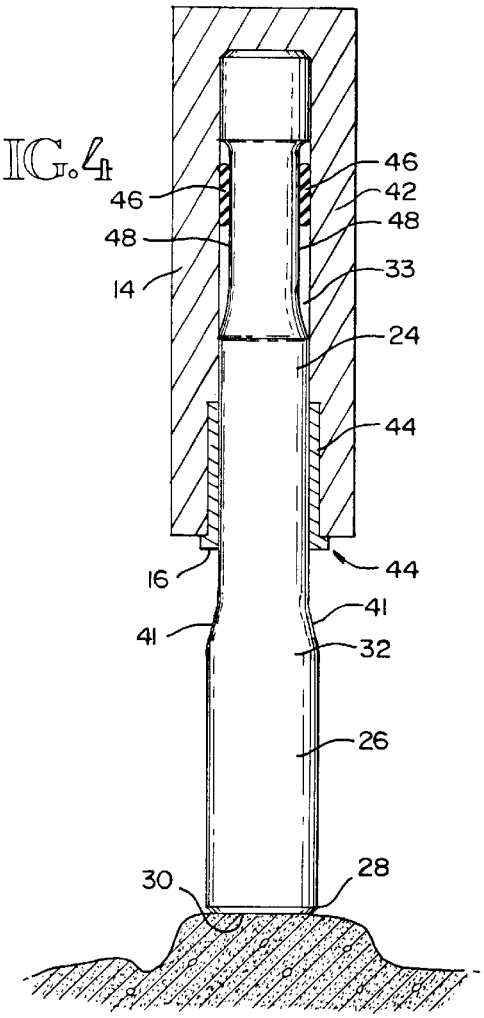
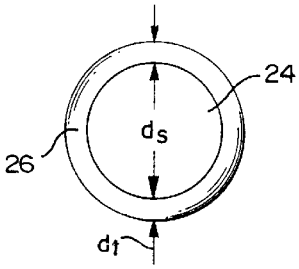
FIG. 3

PERCUSSION TOOL FOR BOOM MOUNTED HAMMERS

RELATED APPLICATION

This application claims the benefit of earlier filed U.S. application Ser. No. 09/048,547, filed Mar. 26, 1998 now abandoned.

TECHNICAL FIELD

The present invention relates to percussion tools, or hammer tools, used in connection with lifting equipment, particularly boom mounted hammers. More particularly, the present invention relates to an improved hammer tool with a forward striking mass portion that is larger in diameter and shorter in longitudinal length than prior art percussion tools in order to provide equal or greater striking mass to the work surface, yet reduce risk of stress fractures.

BACKGROUND OF THE INVENTION

Percussion tool bits, or hammers tools, are commonly used in the construction/demolition/quarry industry. Tool bits having various striking faces, for example, blunt, moil, or chisel striking faces, are chosen for a particular application. Blunt tool bits, which have a flat striking face, are particularly useful for breaking up rocks in quarries. Moils or chisels, which have a generally pointed striking face, may be used in quarries to break up a large rock into smaller pieces or for trenching.

These tool bits can be quite large, typically having a shank diameter of 5–8½ inches and a weight of many hundreds of pounds or more. As such, they are generally used in connection with a hydraulic hammer that is boom mounted. These tools are quite costly, often starting at $1000.00 or more.

The prior art hammer tool 2, as shown in FIG. 1, typically includes an elongated cylindrical body 4 having a shank portion 6 at one end of body 4 and a forward portion 8 at the other end of the body 4. At the distal end 10 of the forward portion 8 is an integral striking face 12 (a blunt face is shown). The shank portion 6 of the hammer tool 2 is received into a chuck housing (not shown) of a power hammer 14, (which is shown in phantom). Much of the body 4, including the forward portion 8 and the striking face 12, extends externally and downwardly of the power hammer 14, below a lower chuck housing face 16. In use, the power hammer is raised and lowered over a work surface (not shown) in order to bring the striking face into striking contact with the work surface, typically in a force range from 800–15,000 foot pounds (depending on the hammer class).

As shown in FIG. 1, the shank portion 6 and the forward portion 8 have a substantially uniform diameter $d_{pa}$ along a longitudinal length $L_{opa}$ of the entire tool. Below lower chuck housing face 16, the diameter of the tool d is uniform along the overall longitudinal length of the forward tool portion $L_{pa}$, which is the longitudinal length of the forward tool portion to the distal end 10. Thus, the portion of the hammer tool extending below the power hammer has to be of a length relative to the diameter of the tool to impart a sufficient force, determined essentially by the hammer manufacturer and force class.

When new, the tool bit is at its maximum longitudinal length. During use, the longitudinal length slightly decreases. Also during use, the length of the tool bit extending below the hammer can tend to flex during rough handling. Such flexing can generate small stress fractures, of which can lead to ultimate catastrophic failure. Ultimate catastrophic failures often occur within the first 24 hours of use of a new tool bit.

An objective of the present invention is to maintain or increase the life of these expensive tool bits by decreasing the length of the tool that extends below the hammer, yet still provide the same or more striking mass.

DISCLOSURE OF THE INVENTION

The present invention relates to a percussion tool or hammer tool bit including a substantially cylindrical rearward shank portion of a first diameter and substantially uniformly cylindrical forward tool portion, which is axially aligned with the shank portion. The forward tool portion has a diameter that is approximately 15–20% greater than the diameter of the shank portion. The shank portion is of a size and shape to be received into a socket, or chuck housing, of a boom mounted power hammer. The forward tool portion further includes a distally positioned striking face. The forward tool portion extends forwardly of the shank portion of a longitudinal length that, when the tool is received into the socket of the hammer and the striking face makes striking contact with a work surface (such as a pile of rocks in a quarry), the longitudinal length will not flex when the tool is operated by the hammer.

In a preferred embodiment of the present invention, the longitudinal length of the forward tool portion is 35–40% of the overall longitudinal length of the percussion tool bit. According to one embodiment, the striking face is no greater than 28 inches. Thus, the forward tool length is such that the tool will not flex, but the increased diameter of the forward tool portion provides the same or more mass as the prior art with each striking contact.

In another embodiment of the present invention, the tool may further include an integral transition section between the shank portion and the forward tool portion. The transition section includes a proximal end and a distal end such that the proximal end of the transition section is adjacent and integral with the shank portion and includes the same diameter as the shank portion. The distal end of the transition section slopes radially outwardly such that the distal end the sloping section of the transition section is adjacent, integral, and includes the same diameter as the forward tool portion. According to one embodiment, the longitudinal length of the forward tool portion and striking face is no greater than 23 inches with the addition of the transition section.

The hammer tool of the present invention can have various striking faces. In one embodiment, the striking face is a blunt surface. In another embodiment, the striking face is a moil point. In yet another embodiment, the striking face is a chisel.

According to another aspect of the present invention, the percussion tool bit of the present invention is an improvement over the prior art percussion tool bit. The prior art percussion tool bit includes a combined longitudinal rearward shank portion and forward tool portion, where the rearward shank portion and the forward tool portion include a substantially cylindrically uniform and integral diameter. The prior art percussion tool bit's forward tool portion further includes a striking face longitudinally opposite the rearward shank portion. The improvement of the present percussion tool bit includes an increased forward tool portion diameter over the rearward shank diameter in the range of 15–20%, and a decreased combined longitudinal length over the combined percussion tool bit of the prior art of 5–10%. The forward tool portion length of the present invention may be in the range of 35–40% of the overall tool length of the present percussion tool bit. The striking face of the present percussion tool bit may be a blunt, moil, or chisel, as discussed above.

These and other advantages, objects, and features will become apparent from the following best mode description, the accompanying drawings, and the claims, which are all incorporated herein as part of the disclosure of the invention.

BRIEF DESCRIPTION OF THE DRAWINGS

Like reference numerals are used to designate like parts throughout the several views of the drawings, wherein:

FIG. 1 is a plan view of the prior art percussion tool having a blunt striking face;

FIG. 2 is a plan view of the percussion tool of the present invention having a blunt striking face and showing the diameter of a forward tool portion of the hammer tool that is 15–20% larger than its corresponding shank diameter and with a 90–95% overall longitudinal tool length of the prior art;

FIG. 3 is an end view of the FIG. 2;

FIG. 4 is a pictorial view of the percussion tool bit of FIG. 2 being received in a boom mounted hammer, which is shown in section, and also showing the blunt striking face making striking contact with its intended surface, such as a rock pile;

BEST MODE FOR CARRYING OUT THE INVENTION

Figure 5:
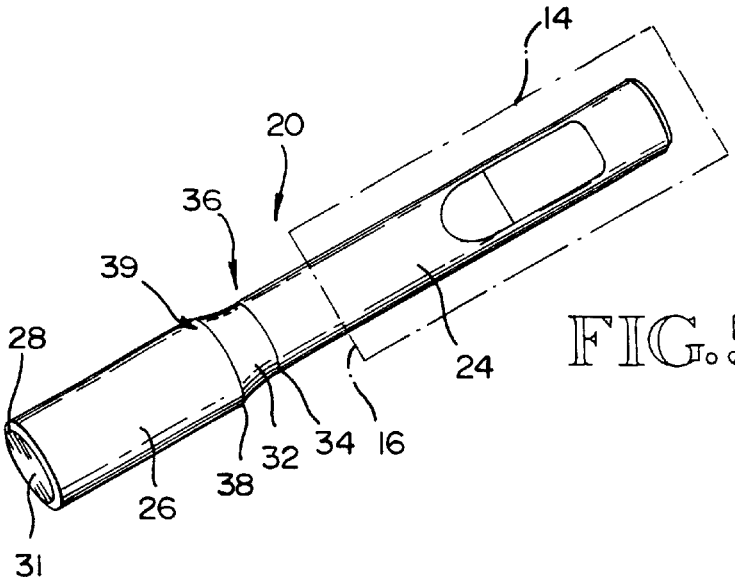
FIG. 5 is a pictorial view of the percussion tool bit of FIG. 2 and better showing the blunt striking face.

Referring to FIGS. 1 and 2, the present invention as shown in FIG. 2 is an improvement of the prior art shown in FIG. 1. To fully appreciate the improvement of the present invention, the prior art needs to be carefully examined.

Referring now only to FIG. 1, as already discussed in the "Background of the Invention," the prior art tool 2 includes a cylindrical body 4, a shank portion 6, and a forward portion 8. The shank portion is designed to be received within a chuck housing (not shown) of a boom mounted hammer 14 (shown in phantom). The shank portion may be of a size to fit any hydraulic or other power hammer manufacturer. The lower face is called the lower chuck housing face 16. This is the lowest surface of the hammer from which the forward portion extends outwardly. The forward portion 8 includes a distal end 10. Integral and extending from the distal end 10 is a striking face 12. A blunt striking face is shown in FIG. 1.

The diameter of the forward portion and the diameter of the shank portion are identical and the diameter shank portion is noted as $d_{pa}$ (diameter of the prior art). This can clearly be shown in FIG. 1. The striking mass of the tool is the result of the longitudinal length of the tool of the prior art $L_{pa}$, (working tool), as measured from the striking face to the lower chuck housing face, in connection with the diameter of the tool dpa. The length and diameter ratio of the prior art tool is dependent on the hammer class and manufacturer. For example, a 7,500 ft-lb class Allied 795 Hammer would have a diameter $d_{pa}$ of 6.275 inches. The overall longitudinal length $L_{opa}$ Of 58 inches; the working tool length is 32 inches.

The problem with the prior art tool is that the working length of the tool $L_{pa}$ extends sufficiently below the chuck housing face 16 that the tool can flex and cause stress fractures during rough handling. Stress fractures lead to catastrophic failure. This is especially true during the first 24 hours of the tool's use, while it is at its longest longitudinal length.

Referring to FIGS. 2–4, the present invention 20 includes a substantially cylindrical body 22, a shank portion 24, and a forward tool portion 26 having a distal end 28 and an integral striking face 30. In use, shank portion 24 is encased in a chuck housing 33 (see FIG. 4) of power hammer 14, which can be the same as shown in the prior art.

Unlike the prior art, however, the diameter of the forward tool portion $d_t$ is 15–25% greater than the diameter of the shank portion $d_s$. The forward tool portion diameter dt is uniform along the longitudinal length L as measured from distal end 28 to lower chuck housing face 16. Because the diameter of the tool portion $d_t$ is uniformly greater than the shank portion diameter $d_s$ and the prior art tool diameter $d_{pa}$, the length of the tool portion L need not be as long as the prior art length $L_{pa}$ to have the same striking mass of the prior art tool. Thus, the overall longitudinal length $L_o$ of the present invention may be significantly shorter than the overall longitudinal length $L_{opa}$ of the prior art. With a shortened length, the available (working) tool portion subject to flexing is minimized. Thus, stress fractures are less likely to occur in the tool of the present invention.

An intermediate portion or transition portion 32 may be added to the present invention tool. The transition section is integral to the shank portion 24 and also the forward tool portion 26. A proximal end 34 of intermediate or transition portion 32 is adjacent and integral with the distal end 36 of the shank portion 24. The transition portion 32 slopes radially outwardly such that the distal end 38 of transition portion 32 is adjacent, integral and the same diameter as that of the (forward) tool portion dt. Thus, as viewed from the top, there are two concave shaped radii 41 leading to the tool portion 26 in order to reduce any stress fractures.

Figure 8:
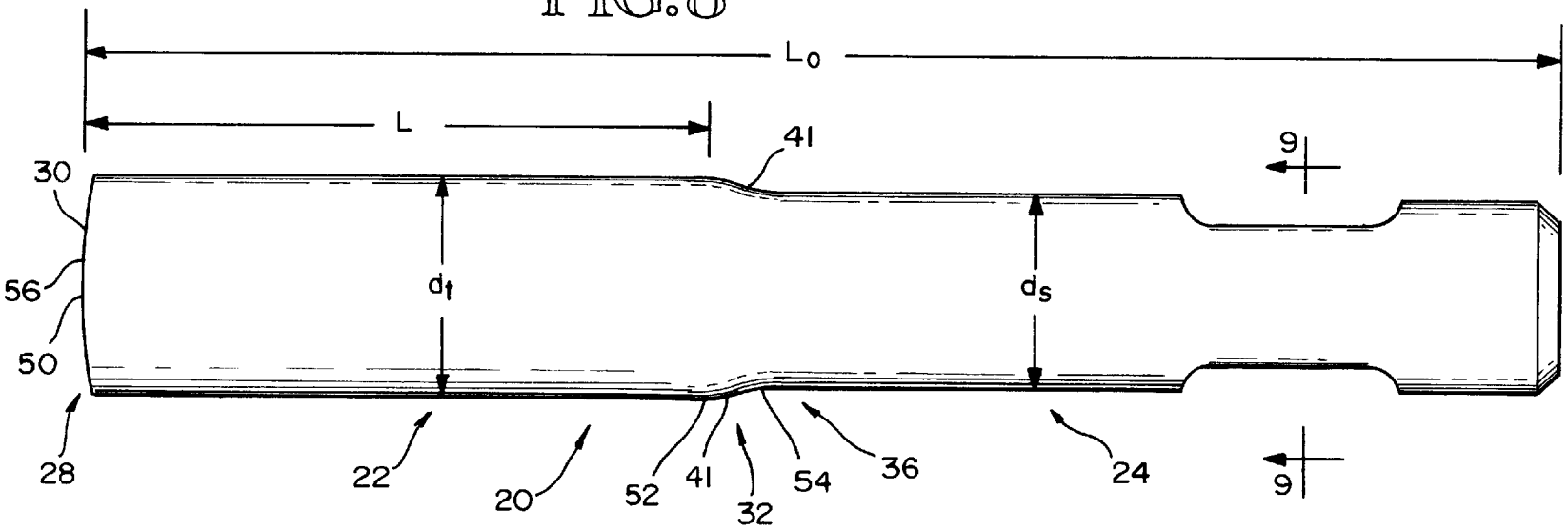
FIG. 8, is an enlarged view of FIG. 2 except the tool is shown having a convex striking face.
Figure 9:
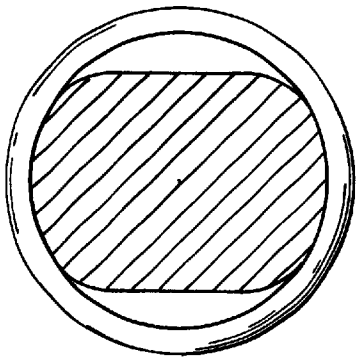
FIG. 9 is a section view taken substantially along lines 9—9 of FIG. 8.

Referring to FIG. 8, which at first glance appears to be an enlarged view of FIG. 2 except disclosing a convex striking face 50, the present invention utilizes the following formulae to achieve the desired tool length to diameter ratios.

$L_o$=90–95% $L_{opa}$

L=35–40% $L_o$ $d_t$=115–120% $d_{tpa}$ (and $d_s$)

$B_{r1}$=55–60% of $d_t$ $B_{r2}$=45–50% of $d_t$

CFR=400% of $d_t$ where $B_{r1}$ is the first blend radius (shown at 52), $B_{r2}$ is the second blend radius (shown at 54), and CFR is the convex face radius (shown at 56).

Typically, longitudinal length of the forward tool length L, is not greater than 28" in order to reduce leverage that causes flexing that can cause stress fractures. In combination with the larger tool portion, the length L can be made shorter, if necessary, and still retain the same striking mass or greater than the prior art, but with reduced risk of flexing.

As already discussed above, the classifications of the power hammers range from approximately 800 ft-lb class to 15,000 ft-lb class. The length of the entire tool from striking face to shank as well as the length of the forward tool portion from striking face to lower chuck housing face is determined by the ft-lb class of the hammer. For example:

| | | 5,000 ft-lb (Allied 785) | 7,500 ft-lb (Allied 798) | 10,000 ft-lb (Tramac BRV5203) |
|---|---|---|---|---|
| Prior Art: | $d_{tpa}$: 5.7" $L_{ops}$ (overall 51" Weight: 368.69 lbs. | $d_s$: 5.88" $d_{tpa}$: 5.88" tool length): 46" $L_{pa}$ (working tool length): 24" | $d_s$: 6.275" 6.275" $L_{opa}$ (overall tool length): 58" $L_{pa}$ (working tool length): 32" | $d_s$: 6.677" $d_{tpa}$: 6.677" (overall tool length): 59" $L_{pa}$ (working tool length): 33" |
| Present Invention | $D_t$: 6.56 to 6.84" $L_o$: (overall tool length): 45.90–48.45" L: (length of the forward tool portion): 16.07–19.38" $B_{r1}$: (blended radius 1): 3.61–4.10 $B_{r2}$: (blended radius 2): 2.95–3.42 CFR: (convex face radius): 26.22–27.36 Weight: 369.27–417.43 lbs | $d_s$: 5.88" $d_t$: 7.0" $L_o$ (overall tool length): 46" L (length of the forward tool portion): 24" 28" | $d_s$: 6.275" $d_t$: 7.50" $L_o$ (overall tool length): 54" L (length of the forward tool portion): | $d_s$: 6.677" $d_t$: 8.0" $L_o$ (overall tool length): 54" L (length of the forward tool portion): 28" |

The shank portion size and shape is heavily dependent on the corresponding power hammer manufacturer's specification. The hammer tool of the present invention may accommodate virtually any power hammer. Although power hammer 14 is normally hydraulic, power hammer 14 is not so limited, as it may be pneumatic of electric in nature. Typical of such hydraulic power hammer manufacturers are Allied, a licensee of Krupp of Germany; NPK or Nippon Pneumatics of Japan; Kent of Japan, Tramac of France, which is a division of Ingersoll Rand Corporation; and Rammer of Finland. The power hammer 14 as shown is a Kent 50G model.

Referring specifically to FIG. 4, hammer tool 20 is received into a socket or chuck housing 33 within power hammer 14. Typical to most, if not all power hammers, each power hammer 14 includes an outer bushing 42, which receives and supports shank portion 24. An inner bushing 44 also supports shank portion 24. Typically, power hammer 14 generally includes a detent 46, shown in the form of a release bar, which holds a notched portion 48 of shank portion 24 firmly within socket or chuck housing 33. The outer bushing 42, inner bushing 44, and detent 46 act in concert to securely receive and support hammer tool 20 and restrain it from any lateral movement.

As shown above, in the lower classes of hammers such as the 5000 ft-lb class, the overall length of the tool is such that the forward tool portion that extends from the lower chuck facing will still be under 28 inches. Therefore, the present invention does not need a length $L_o$ shorter than that of the prior art. However, in the larger classifications of 7,500 and 10,000 ft-lbs and up, the overall length $L_o$ is significantly shorter (approximately four to five inches shorter) than the prior art. These four to five inches greatly decreases the risk of flexing that can cause stress fractures.

The tool of the present invention is preferably machined on a lathe. In preferred form, the turning of the radius is preferably begun five inches outside the lower chuck housing face 16. This actually makes the length of the transition portion length of the tool portion 23 inches or less.

Figure 6:
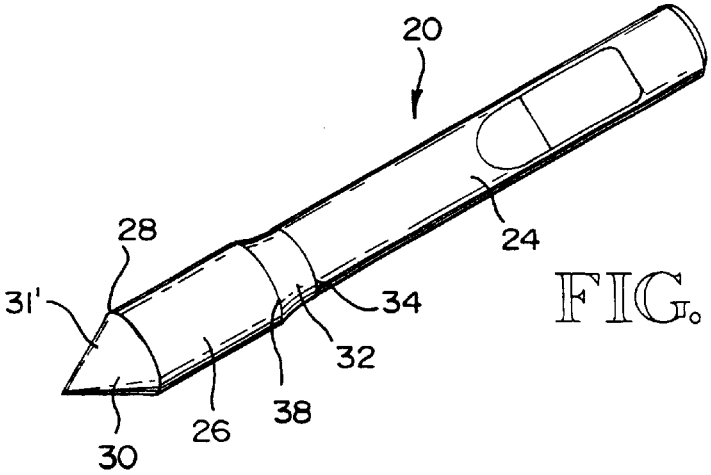
FIG. 6 is a pictorial view of an alternate embodiment of the percussion tool of the present invention having a moil striking face.
Figure 7:
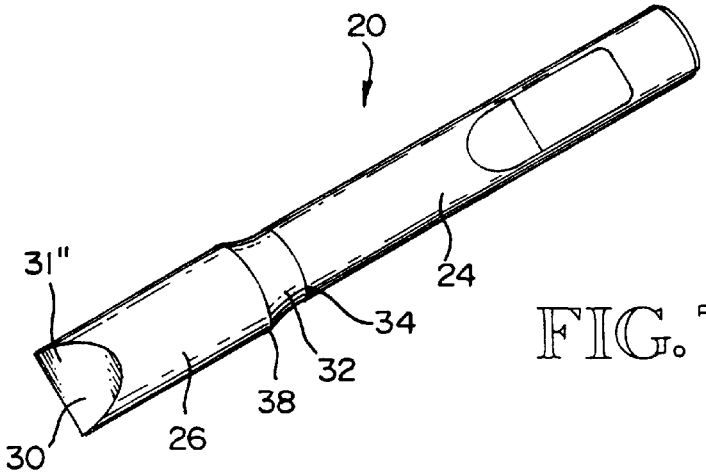
FIG. 7 is a pictorial view of a second alternate embodiment of the present invention having a chisel striking face.

As shown in FIGS. 2–4, the tool of the present invention includes a blunt striking face 31. This is also better shown in FIG. 5. However, the striking face may be of other varieties as those shown in FIGS. 6 and 7. FIG. 6 shows a moil point 31', while FIG. 7 shows a chisel striking face 31". The moil 31' and chisel 31" may be used for breaking up a large rock or for trenching, whereas the blunt striking face 30 is particularly useful for breaking up volumes of rocks.

Once the hammer tool has completed the machining process, the hammer tool is then subjected to heat treatment in order to meet the breaking strength requirements of 200,000 psi.

The hammer tools of the present invention are made of alloy steel such as EN30b or ANSI 4340.

The illustrated embodiments are only examples of the present invention and, therefore, are non-limitive. It is to be understood that many changes in the particular structure, materials and features of the invention may be made without departing from the spirit and scope of the invention. Therefore, it is the applicant's intention that its patent rights not be limited by the particular embodiments illustrated and described herein, but rather by the following claims, interpreted according to accepted doctrines of claim interpretation, including the doctrine of equivalents and reversal of parts.

What is claimed is:

1. A percussion tool bit comprising:

a substantially solid cylindrical rearward shank portion of a first diameter, said rearward shank portion being of a size and shape to be received into a socket of a boom mounted hammer;

a substantially solid uniformly cylindrical forward tool portion, axially aligned with the rearward shank portion, and having an elongated uniformly cylindrical second diameter that is approximately 15–20% greater than the rearward shank portion diameter;

said forward tool portion further including a distally-positioned striking face;

said forward tool portion extending forwardly of the shank portion of a longitudinal length that when the tool is received into the socket of the hammer, the longitudinal length will not flex when the tool is operated by the hammer such that the tool's striking face makes striking contact with a work surface.

2. The percussion tool bit according to claim 1, wherein the longitudinal length of the forward tool portion is 35–40% of the overall longitudinal length of the percussion tool bit.

3. The percussion tool bit according to claim 1, wherein the longitudinal length of the forward tool portion and the striking face is no greater than 28 inches.

4. The percussion tool bit according to claim 1, further comprising an integral transition section between the rearward shank portion and the forward tool portion, wherein the transition section includes a proximal end and a distal end such that the proximal end is adjacent and integral with the rearward shank portion and includes the same diameter as the rearward shank portion, and wherein the distal end of the transition section slopes radially outwardly such that the distal end of the transition section is adjacent, integral, and has the same diameter of the forward tool portion.

5. The percussion tool according to claim 4, wherein the longitudinal length of the forward tool portion and the striking face is no greater than 23 inches.

6. The percussion tool according to claim 1, wherein the striking face includes a blunt surface.

7. The percussion tool according to claim 1, wherein the striking face comprises a moil point.

8. The percussion tool according to claim 1, wherein the striking face comprises a chisel.

9. In a percussion tool bit having a combined longitudinal rearward shank portion and a forward tool portion, wherein the rearward shank portion and the forward tool portion include a substantially cylindrically uniform and integral diameter, and wherein the forward tool portion includes a striking face longitudinally opposite the rearward shank portion, the improvement comprising:

an increased forward tool portion diameter over the rearward shank diameter in the range of 15–20%.

10. The percussion tool bit according to claim 9, wherein the longitudinal length of the forward tool portion of the tool bit is 35–40% of the combined overall longitudinal length of the percussion tool bit.

11. The percussion tool bit according to claim 9, wherein the striking face of the percussion tool bit includes a blunt surface.

12. The percussion tool bit according to claim 9, wherein the striking face of the percussion tool bit comprises a moil point.

13. The percussion tool bit according to claim 9, wherein the striking face of the percussion tool bit comprises a chisel.

* * * * *